US005233728A

United States Patent [19]

Whiteley et al.

[11] Patent Number: 5,233,728

[45] Date of Patent: Aug. 10, 1993

[54] DRIVE BETWEEN AN AUTOLEVELLER AND A COILER

[75] Inventors: John Whiteley, Lancashire, United Kingdom; Julian E. Hankinson, Jr., Spartanburg, S.C.

[73] Assignee: John D. Hollingsworth On Wheels, Inc., Greenville, S.C.

[21] Appl. No.: 875,892

[22] Filed: Apr. 29, 1992

[30] Foreign Application Priority Data

May 1, 1991 [GB] United Kingdom ..... 9109371

[51] Int. Cl.[5] ..... D04H 11/00

[52] U.S. Cl. ..... 19/159 R

[58] Field of Search ..... 19/159 R, 106 R, 150, 19/153, 157, 244, 159 A, 239, 258, 293; 474/117, 135, 138

[56] References Cited

U.S. PATENT DOCUMENTS

| | | | |
|---|---|---|---|
| 2,771,641 | 11/1956 | Duesberg | 19/161 |
| 3,195,187 | 7/1965 | Kalwaites | 19/150 |
| 3,417,436 | 12/1968 | Masorel | 19/258 |
| 4,389,751 | 6/1983 | Gyger et al. | 19/0.35 |
| 4,473,924 | 10/1984 | Hartmannsgrober et al. | 19/239 |
| 4,498,889 | 0/1985 | Stevens et al. | 474/135 |
| 4,691,414 | 9/1987 | Kluttermann | 19/159 R |
| 5,021,032 | 6/1991 | Macchiarulo et al. | 474/135 |

FOREIGN PATENT DOCUMENTS

| | | | |
|---|---|---|---|
| 0354653 | 6/1989 | European Pat. Off. . | |
| 0376002 | 12/1989 | European Pat. Off. . | |
| WO81/00118 | 1/1981 | PCT Int'l Appl. . | |
| 180048 | 4/1966 | U.S.S.R. | 474/117 |
| 794445 | 5/1958 | United Kingdom . | |
| 1393775 | 5/1975 | United Kingdom . | |

*Primary Examiner*—Clifford D. Crowder
*Assistant Examiner*—Michael A. Neas
*Attorney, Agent, or Firm*—Leatherwood, Walker, Todd & Mann

[57] ABSTRACT

A drive between an autoleveller output and a coiler in a carding and deposition assembly comprises slack take-up means, and means for varying the length of the sliver path. In a belt drive, the slack take-up is effected on both sides of the belt drive by dancing pulleys. These may be resiliently biassed, either by a helical tension spring, by the belt elasticity and pulley geometry, or other suitable means.

16 Claims, 2 Drawing Sheets

DRIVE BETWEEN AN AUTOLEVELLER AND A COILER

BACKGROUND OF THE INVENTION

This invention relates to a drive between an autoleveller and coiler head, as are found in carding and deposition assemblies for the production of sliver.

In carding and deposition assemblies, sliver is produced as the carded web is doffed from the carding cylinder, at which point the sliver is subjected to autolevelling. This procedure introduces very short-term draft rate variations between two or more pairs of drafting nip rollers in the sliver path. Its purpose is to cause the sliver quality to become more consistent by variably stretching it to remove inconsistencies in sliver weight.

The sliver is then conventionally passed to a coiler head, which lays the sliver in epicycloidal loops in a can, in a manner known per se. For continuous operation sliver must be deposited at the same average rate as it is produced from the autoleveller, which will not in general operate at the same speed as the card and doffer since it introduces a draft to the sliver..

It is an object of the invention to provide a drive between an autoleveller and a coiler which allows sliver to be deposited at the same average rate as it is produced from the autoleveller, while isolating coiler inertia from the autoleveller.

SUMMARY OF THE INVENTION

According to one aspect of the present invention there is provided a drive system for use between an autoleveller and a coiler defining portions of the belt respectively upstream and downstream of the autoleveller, comprising:

slack take-up means adapted to increase or decrease the path lengths of both upstream and downstream portions of the belt, the slack take-up means being effective to increase and decrease the path lengths of the respective portions of the belt at substantially the same rate, and the drive system being effective to respond to an increase in path length of the downstream portion of the belt, by shortening the downstream portion.

The purpose of the drive between the autoleveller and the coiler head is to provide a sufficiently constant drive for the same quantity of sliver to be coiled as is output from the autoleveller, in the long-term, as well as to isolate the coiler head inertia from the autoleveller, which would otherwise increase the response time of the autoleveller intolerably.

Preferably, the slack take-up means are biassed to take up the increase in path length of the downstream portion of the belt.

Advantageously, the high and low tension portions of the belt may be taken up by the slack take-up means via one or more dancing pulleys.

Further, the slack take-up means may comprise a sliver assisting pulley for guiding a sliver along a sliver path, the assisting pulley being adapted to co-operate with the sliver path so as to vary the sliver path length between the autoleveller and the coiler in accordance with the motion of the slack take-up means.

With this feature the slack in the sliver about the sliver assisting pulley may be maintained substantially constant. This allows the sliver assisting pulley to be shaped so as to avoid creasing or buckling of the sliver (a delicate substantially cylindrical structure) as it passes in a catenary loop from the autoleveller to the coiler.

A further aspect of the invention provides a drive assembly between an autoleveller and a coiler comprising: a path for sliver between the autoleveller and coiler; a drive between the autoleveller and coiler; means for compensating for variations in speed ratio between the autoleveller and coiler effective to introduce and take-up slack in the drive; and means for varying the length of the sliver path responsive to the compensation means.

BRIEF DESCRIPTION OF THE DRAWINGS

The invention will further be understood from the following description when taken with the accompanying drawings which are given by way of example only and in which.

DETAILED DESCRIPTION OF THE PREFERRED EMBODIMENT

Figure 1:
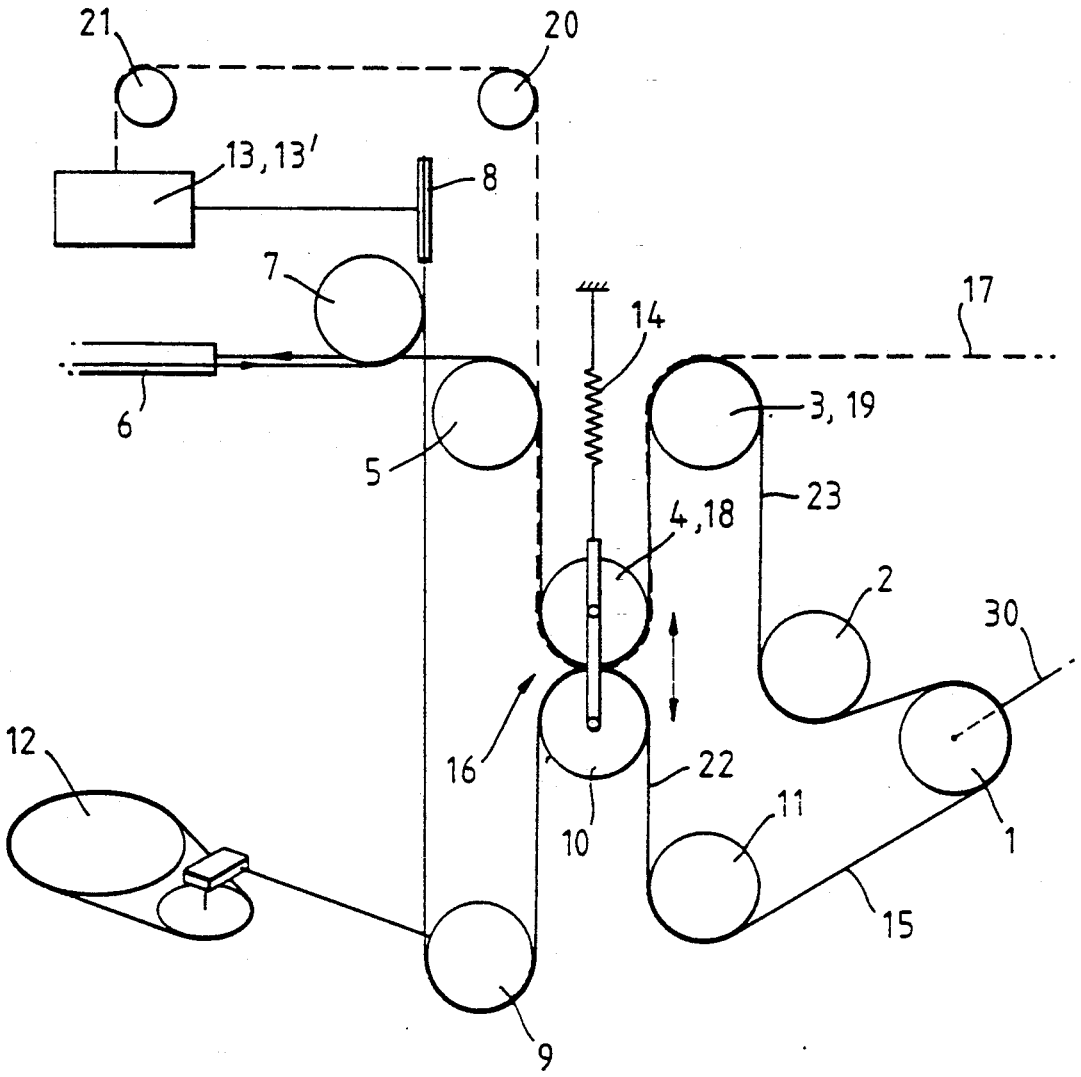
FIG. 1 is a schematic side elevation of a belt drive according to the present invention.

FIG. 1 shows a first embodiment of a drive according to the invention. The drive between the autoleveller output pulley 1 and the coiler head tube wheel 6 is via belt 15. The belt passes via a deflecting pulley 2 and over a belt tensioning spring loaded pulley 3. The belt then passes through a slack take-up assembly 16 and onto the first belt deflecting pulley 5 of the coiler head tube wheel After the tube wheel, the belt passes to a second tube wheel deflecting pulley 7 and is deflected up to a calender roller drive pulley 8. The drive from pulley 8 is used to drive calender rollers 13, 13'. The belt then passes around a can drive input pulley 9 and back up to the slack take-up assembly 16 where it is passed over pulley 10 and then returns to the autoleveller pulley 1 via a deflecting pulley 11. The slack take-up assembly comprises two pulleys 4, 10 and a spring 14, in this case a helical tension spring although any resilient biassing means may be used. The slack take-up assembly may however comprise two coaxial pulleys.

The slack take-up assembly 16 is movable in the vertical direction as shown by the arrows. The belt paths immediately adjacent the slack take-up means are arranged to be parallel with the direction in which the slack take-up means is movable.

A path for the sliver 17 is defined by sliver assisting pulleys 18 to 21. A sliver assisting pulley 18 is arranged to be moved by the slack take-up means 16 and may preferably be arranged to be co-axial with pulley 4. More particularly, the effective diameters of the two pulleys are preferably the same, and the two drivingly connected. Advantageously, the sliver assisting pulleys are shaped so as to cause minimal disruption to the delicate cylindrical structure of the sliver. Another sliver assisting pulley 19 is arranged so that the sliver path between the pulley 19 and pulley 18 is substantially parallel to the belt path between pulleys 3 and 4. Sliver assisting pulley 19 may be disposed above pulley 3, or coaxial with it, and adjusted so that its effective peripheral speed is equal to that of pulley 3. A sliver deflecting pulley 20 is disposed somewhat above the belt drive mechanism and defines a part of the sliver path which is substantially parallel to the belt drive between pulleys 4 and 5. The sliver path further includes a last sliver deflecting pulley 21 and calender rollers 13, 13, which draw the sliver into the coiler head.

In use, the autoleveller output pulley 1 is driven with the final draft roller shaft 30 of an autoleveller in the anticlockwise direction as shown in FIG. 1. The drive is therefore transmitted to the tube wheel of the coiler head 6, the tensions imposed on the belt 15 by the drive from the autoleveller differing in the upstream and downstream portions 22 and 23 respectively, of the belt drive. This difference in belt tensions and variations in the difference cause the slack take-up mechanism 16 to move either up or down, as shown in FIG. 1, with or against the return force of the biassing means 14. In steady state operation, the coiler head is driven at a speed dependent on that of the autoleveller output pulley 1. Due to the operation of the autoleveller, the rate at which the sliver 17 is output from the autoleveller varies, in order to maintain the sliver quality. The rate at which the autoleveller output pulley 1 rotates therefore varies as a function of the instantaneous rate at which the autoleveller is drafting, and therefore the rate at which the sliver 17 is fed out. Since the drive between the autoleveller output pulley 1 and the coiler head 6 is cushioned by the action of the slack take-up means 16, the response of the coiler head to changes in the speed of rotation of pulley 1 is somewhat delayed.

The effect of e.g. the downward movement of the slack take-up means 16 is to allow the coiler head to lag behind the autoleveller output pulley 1 in its response to the autoleveller speed changes. The downward movement of the slack take-up assembly 16 causes the downward movement of sliver assisting pulley 18, thus lengthening the sliver path; this causes the excess of sliver in the path due to the lag of the coiler head and the excess of the sliver produced by the autoleveller to be taken up. Put another way, the speed of the sliver between pulleys 18 and 20 is in one-to-one relation to the belt speed between pulleys 4 and 5. By appropriate choice of the sliver speed through the calender rollers 13, 13' and the rate of rotation of the coiler head, the rate of arrival of sliver at the calender rollers 13, 13' may be kept proportional to the rate of rotation of the calender rollers themselves.

Clearly, the system may be adapted for the coiler head, to rotate at other speeds, or to deposit sliver at different rates with the movement of sliver assisting pulley 18 parallel to that of the slack take-up means 16 being geared, e.g. by simple lever gearing.

Figure 2:
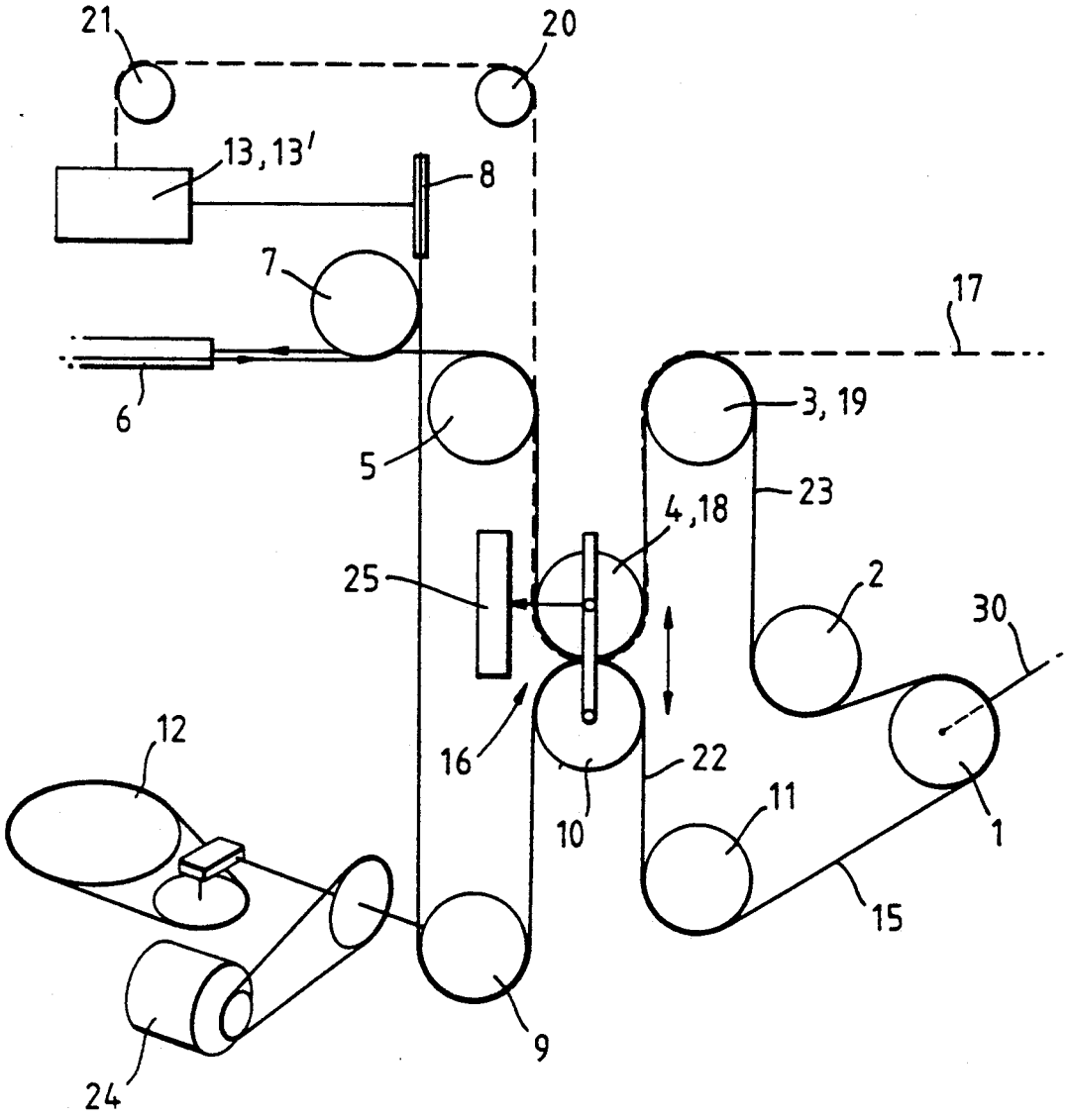
FIG. 2 shows a second embodiment of the invention.

A second embodiment of the invention, shown in FIG. 2, involves the introduction of a variable speed motor 24 in the drive system between pulley 9 and a can drive pulley 12, on which a can to be filled by the silver from the coiler head is positioned. In this embodiment, the spring 14 is not used, but the variable speed motor is adapted to operate in response to and under the control of a position sensing device 25 disposed between the assembly frame and the slider of the slack take-up device 16. Thus, by appropriate control of the motor in accordance with output of the position sensor 25, the inertia of the can and the coiler may be masked from the autoleveller output, and thus the autoleveller mechanism. The motor 24 need not be disposed only between the pulley 9 and the can drive but may be at any position in the system provided it is on the side of the slack take-up means remote from the autoleveller. The control for motor 24 is effective to introduce variations in the tensions of the upstream and downstream portions of the belt so as to return the slider of the slack take-up means to a central position.

While a preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the arts without departing from the spirit or scope of the following claims.

We claim:

1. A drive system for use between an autoleveller having a drive and a coiler, the drive system comprising:

a belt defining upstream portions adjacent the autoleveller and downstream portions adjacent the coiler, the upstream and downstream portions of the belt each having substantially dependently variable path lengths;

drive means connected to said belt for driving said belt; and slack take-up means for increasing and decreasing the path lengths of both upstream and downstream portions of the belt at substantially the same rate and for responding to an increase in the path length of the downstream portion of the belt by shortening the downstream portion.

2. A drive system according to claim 1, further comprising biassing means connected to said slack take-up means, wherein the slack take-up means is biassed to produce respectively predetermined path lengths for the upstream and downstream portions of the belt.

3. A drive system according to claim 2 wherein the biassing means comprise a spring attached to the slack take-up means.

4. A drive system according to claim 2, wherein the belt has elasticity and wherein the biassing means comprise the belt elasticity, the slack take-up means decreasing and increasing the length of the upstream portion of the belt path at a lower rate than the slack take-up means correspondingly decreases and increases the length of the downstream portion of the belt path.

5. A drive system according to claim 2, wherein the slack take-up means includes dancing pulleys and wherein the upstream and downstream portions of the belt are taken up via the dancing pulleys of the slack take-up means, the dancing pulleys being reciprocatable in a predetermined path, and biassed in a predetermined biassed direction, the upstream and downstream belt portions being disposed about the dancing pulleys and urging the dancing pulleys in a direction opposite to the predetermined biassed direction via the differences in belt tension between the upstream and downstream portions due to a drive from the autoleveller.

6. A drive system according to claim 5 wherein the slack take-up means comprise one of said dancing pulleys for each of the upstream and downstream portions of the belt, the dancing pulleys being mounted for rotation on a carrier guided so as to reciprocate substantially in the predetermined path, and the belt paths of both the upstream and downstream portions being substantially parallel adjacent the dancing pulleys.

7. A drive system according to claim 6, wherein the slack take-up means further comprise a sliver assisting pulley defining a sliver path for guiding a sliver along the sliver path, the sliver assisting pulley cooperating with the sliver path so as to vary the sliver path length between the autoleveller and the coiler in accordance with the motion of the slack take-up means.

8. A drive system according to claim 7 wherein the sliver speed is maintained substantially equal to the belt speed, the paths of the downstream portion of the belt and sliver being congruous in the vicinity of the slack take-up means.

9. A drive system according to claim 1, wherein variable drive means are disposed in the drive means, on a side of the slack take-up means remote from the autoleveller, and responsive to the slack take-up means.

10. A drive system according to claim 9, further comprising a sensor associated with the variable drive means, wherein the variable drive means are controlled in response to the sensor on the slack take-up means to substantially isolate from the autoleveller inertia in the drive.

11. A drive system according to claim 10, further comprising a can drive pulley associated with the belt and wherein the variable drive means are drivingly engaged with the drives to the coiler and the can drive pulley.

12. A drive assembly between an autoleveller and a coiler, a sliver path having a path length being defined between the autoleveller and the coiler, the drive assembly comprising:

drive means between the autoleveller and the coiler;

slack take-up means in the drive means for compensating for variations in the speed ratio between the autoleveller and the coiler for introducing and taking up slack in the drive means; and means for varying the length of the sliver path responsive to the slack take-up means.

13. A drive assembly according to claim 12 wherein the means for varying the length of the sliver path maintains a substantially constant difference between the sliver path length and a length of sliver between the autoleveller and the coiler.

14. A drive assembly according to claim 12, wherein variable drive means are disposed in the drive, on a side of the slack take-up means remote from the autoleveller, and responsive to the slack take-up means.

15. A drive assembly according to claim 14, further comprising a sensor associated with the slack take-up means and wherein the variable drive means are controlled in response to the sensor on the slack take-up means to substantially isolate from the autoleveller inertia in the drive.

16. A drive assembly according to claim 15, further comprising a can drive pulley and wherein the variable drive means are drivingly engaged with the drives to the coiler and the can drive pulley.

* * * * *